United States Patent [19]

Swindell et al.

[11] 4,440,725

[45] Apr. 3, 1984

[54] REGENERATOR TEMPERATURE CONTROL

[75] Inventors: Harold J. Swindell, Kansas City; Randall G. Thompson, Odessa, both of Mo.

[73] Assignee: Phillips Petroleum Company, Bartlesville, Okla.

[21] Appl. No.: 400,832

[22] Filed: Jul. 22, 1982

Related U.S. Application Data

[62] Division of Ser. No. 193,870, Oct. 3, 1980, now Defensive Publication No. 4,354,957.

[51] Int. Cl.[3] ..... G01N 31/12; B01J 8/24; G05D 7/00; G05D 23/00

[52] U.S. Cl. ..... 422/62; 422/89; 422/94; 422/111; 422/144; 422/109; 364/500; 364/160; 364/161; 364/180; 502/41; 502/52

[58] Field of Search ..... 422/62, 94, 109, 111, 422/144; 436/133, 134; 252/417, 419; 364/160, 161, 180, 500

[56] References Cited

U.S. PATENT DOCUMENTS

| | | | |
|---|---|---|---|
| 2,344,770 | 3/1944 | Gunness | 242/419 |
| 2,817,691 | 12/1957 | Hutchins | 252/419 |
| 3,410,793 | 11/1968 | Strandon et al. | 422/144 X |
| 3,966,587 | 6/1976 | Bittensby et al. | 252/417 X |
| 4,217,243 | 8/1980 | Christie | 252/417 X |

*Primary Examiner*—Michael S. Marcus
*Assistant Examiner*—Robert J. Hill, Jr.

[57] ABSTRACT

A regenerator control system is disclosed which is particularly useful in connection with combustion promoted cracking catalysts. The air flow is controlled responsive to the temperature in the dilute phase, first in a direct mode when the amount of combustibles on the catalyst is at or above a set point and second in accordance with a reverse mode when the amount of combustibles is below such a set point. This versatile control system allows a safe operation of a regenerator under a variety of conditions.

3 Claims, 2 Drawing Figures

FLUID CAT CRACKING UNIT REGENERATOR
TEMPERATURE CONTROL SYSTEM

REGENERATOR TEMPERATURE CONTROL

This application is a division of application Ser. No. 193,870, filed Oct. 3, 1980 now U.S. Pat. No. 4,354,957.

This invention relates to the control of the temperature in a regenerator of a catalytic cracking operation. More specifically, the invention relates to a dual control mode allowing stable temperature control under unstable regenerator combustion conditions.

BACKGROUND OF THE INVENTION

Catalytic cracking has reached a significant degree of sophistication, particularly in the field of controls systems. It is well known to use conditions such as the flue gas temperature or the difference between the flue gas temperature and dense bed temperature in regenerator to control the cracker-regenerator-loop operation, e.g., by manipulating the flow of oxygen into the regenerator.

Basically in every catalytic cracking system there is a cracker-regenerator-loop in which the catalyst is contacted with hydrocarbon feedstock, such as a gas oil or a topped crude oil and coke is deposited on the catalyst during the cracking step. The quantity of coke depends among several factors upon the feedstock and the cracking conditions. The coke on the catalyst is the fuel for the regenerator. There the coke is burned, at least partially, from the catalyst. The flue gases leaving the regenerator are usually passed through cyclone separators to remove entrained solids (catalyst particles). The flue gases are very hot and a slight increase in temperature may cause damage to these cyclones.

An increase in the addition of air, or other free oxygen containing gases, to the regenerator will usually result in more combustion, particularly more afterburning in the dilute phase converting carbon monoxide to carbon dioxide. This increases in combustion results in a temperature increase. It is however, not always true that increased air addition to a regenerator will result in an increased temperature of the dilute phase of the regenerator. It is therefore desirable to have a control system for a regenerator available that is flexible enough to operate in different and changing modes of combustion efficiently.

THE INVENTION

It is thus one object of this invention to provide a new regenerator control system which is flexible and can be used under varying conditions.

Another object of this invention is to provide a new regenerator control system that can be used in connection with cracking catalysts which have oxidation promotors on the catalyst so that the combustion in the dense phase of the regenerator progresses essentially completely to carbon dioxide.

Still a further object of this invention is to provide a process to regenerate used cracking catalysts employing the novel control approach.

Yet another object of this invention is to provide a cracking process wherein the control system that is operative in two different modes is employed for the catalyst regenerator step.

Figure 1:
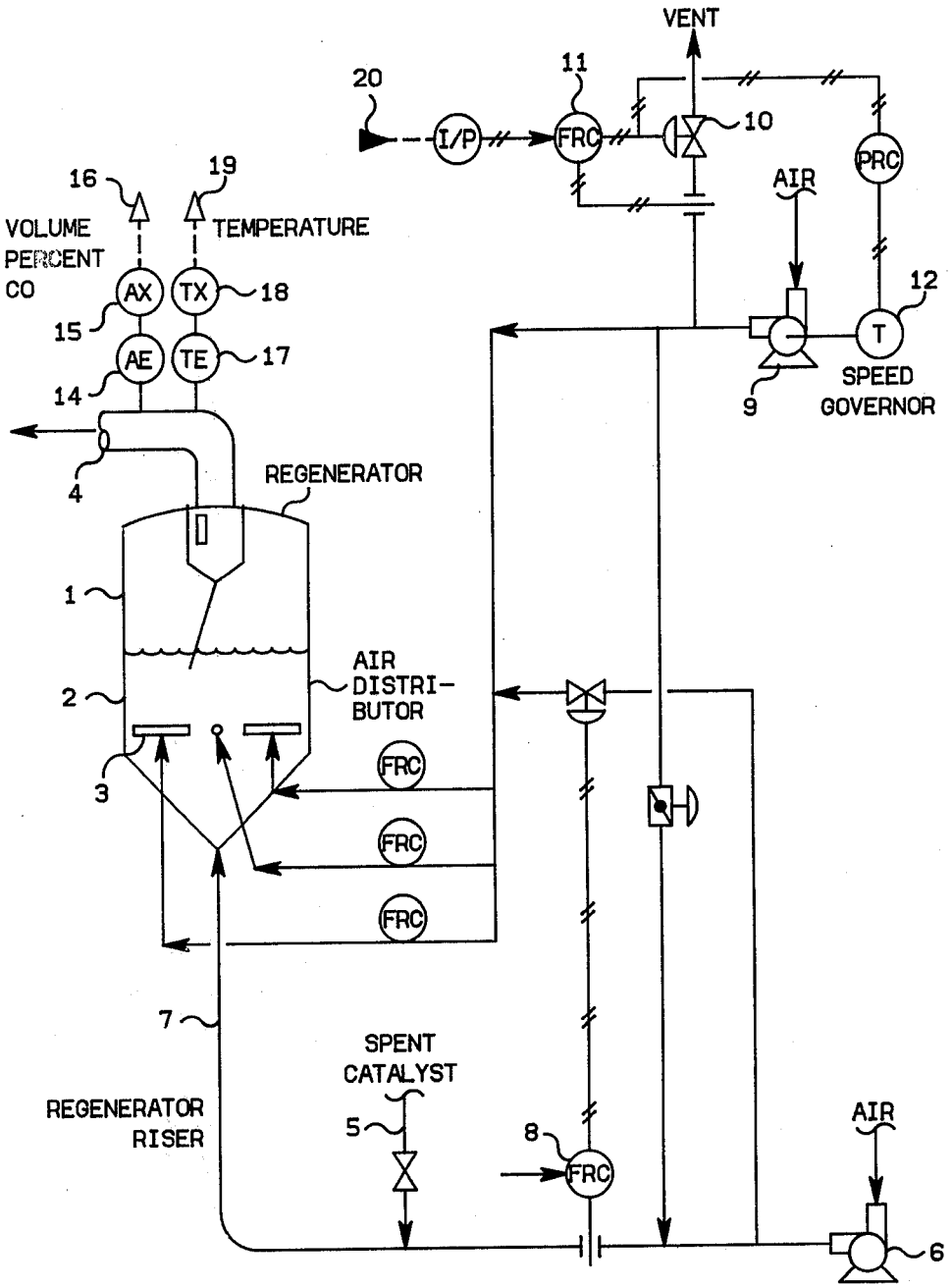
Figure 2:
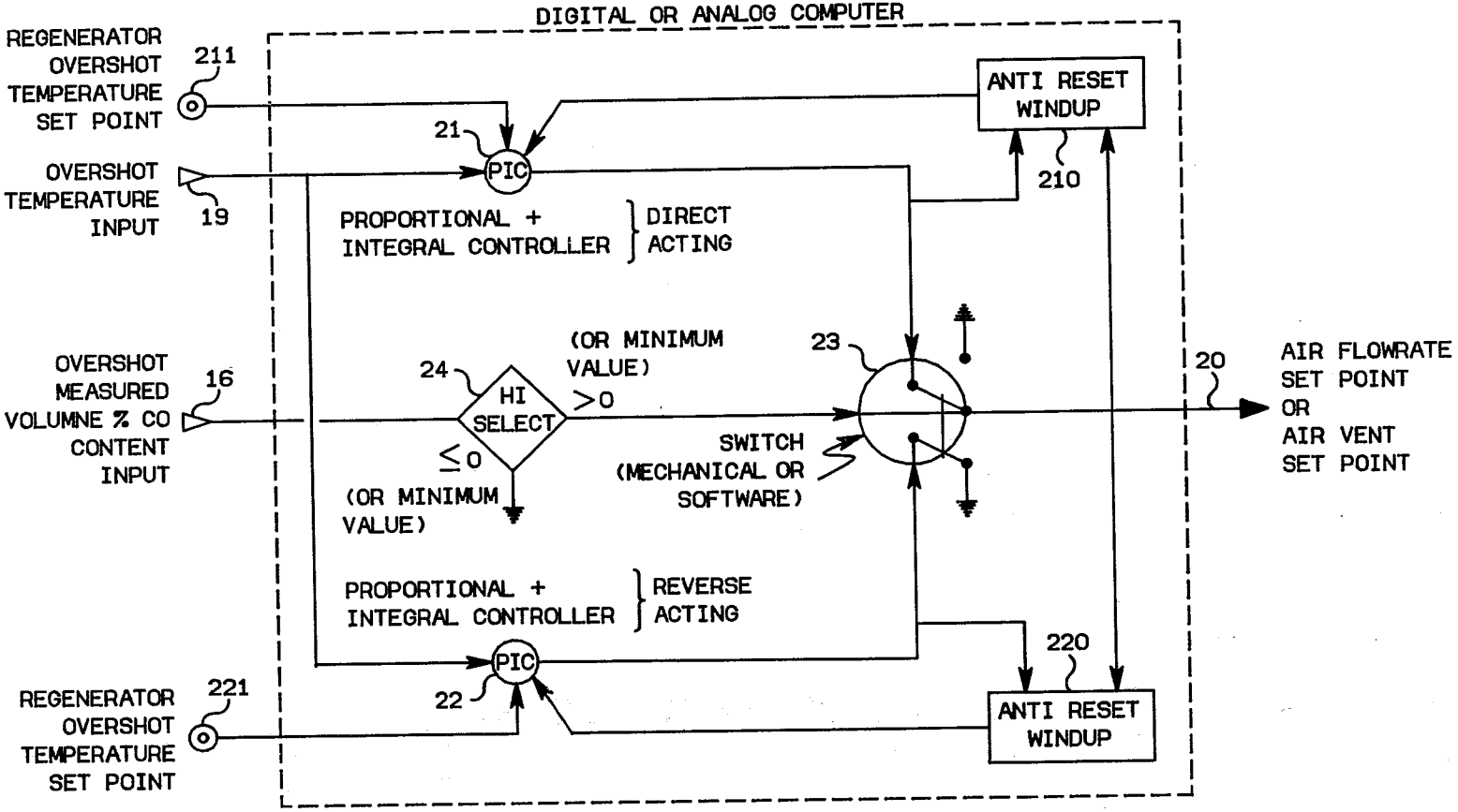

These and other objects, advantages, details, features and embodiments of this invention will become apparent to those skilled in the art from the following detailed description of the invention, the appended claims and the drawing in which FIG. 1 schematically shows the regenerator and the control inputs and outputs, and FIG. 2 schematically shows the control system for the regenerator.

In accordance with this invention the control system is provided which determines the amount of combustibles on the catalyst particles and responsive thereto automatically switches from one mode of the control system to another mode of the control system. In case there is enough combustible material on the catalyst the regenerator is operated under a normal control mode, i.e., a mode wherein the addition of oxygen to the regenerator is increased when the flue gas temperature or dilute phase temperature is below a set point and vice verse the flow of oxygen into the regenerator is decreased whenever the flue gas or dilute phase temperature is above a set point. When the amount of combustibles on the catalyst particles has fallen below a lower limit the control system is switched to a reverse acting control system. This means that the flow of oxygen into the regenerator is reduced when the temperature of the flue gas or the dilute phase falls below a given set point [and correspondingly the flow of oxygen into the regenerator is increased when the temperature in the dilute phase or flue gases rises above the given set point].

When there exists sufficient combustiles to be burned in the regenerator, the temperature is controlled by adding air to increase the amount of combustion and thus to increase the temperature. When insufficient combustibles exist for a combustion in the regenerator, an increase of air will result in a drop of temperature due to the cooling effects of the added cooler air. Therefore, the control system in this situation will switch to the reverse control of reducing air flow to increase the temperature. The control system of this invention can be implemented either by an analog or by a digital computer controller.

In accordance with a first embodiment of this invention, a process to regenerate a coke-laden cracking catalyst is provided for. The coke-laden cracking particles are contacted with a stream of free oxygen containing gas in a regeneration zone to form a lower, dense bed of catalyst particles and a dilute phase above the dense bed. In the dense bed at least a significant portion of the coke on the catalyst particles is combusted to form a flue gas containing carbon monoxide. The dilute phase comprises the flue gas and a very small quantity of catalyst fines. The temperature in the dilute phase is used to control the flow of free oxygen containing gas into the regeneration zone in an improved manner, namely by a duel mode control system. In accordance with this invention, the amount of combustibles on the catalyst particles is determined and a corresponding combustibles signal is generated responsive to this determination. The flow of free oxygen containing gas is controlled responsive to the temperature in the dilute phase in a first control mode when the combustibles signal is representative of a sufficient amount of combustibles and is controlled in a second control mode when the combustibles signal is representative of an insufficient amount of combustibles in the regenerator. In the first regeneration mode the flow of free oxygen containing gas into the regenerating zone is increased (or, respectively, decreased) when the temperature in the dilute phase has fallen below (or, respectively, risen above) a set point. In the second regenerator control mode the control is the reverse of the first mode, namely the flow of free oxygen into the regeneration zone is decreased when the temperature in the dilute phase has fallen below a temperature set point.

The combustibles signal is preferably generated by measuring the carbon monoxide content in the flue gas or in the dilute phase. When the carbon monoxide content is above a set point, this is indicative of a sufficient amount of combustibles present in the regenerator. Vice Versa, when the carbon monoxide content has fallen below a set point, this is indicative of a depletion of combustibles in the regenerator. The control is therefore preferably carried out by using a carbon monoxide signal representative of the carbon monoxide content in the dilute phase.

The present invention is particularly useful in connection with modern cracking catalysts which are designed to achieve a combustion all the way to carbon dioxide in the dense phase. Such catalysts, which can be characterized as oxidation promoted catalysts, are described in the following U.S. Patent Nos.: 4,088,568; 4,174,272; 4,164,465; 4,164,464; 4,115,251; 4,115,250, among many others. These modern cracking catalysts, containing oxidating promoters, are preferably used in connection with the present invention and the direct control of the flow of free oxygen containing gas into the regenerator responsive to the dilute phase temperature is switched to the indirect, or reverse control mode, whenever the carbon monoxide content in the dilute phase falls below or rises above a set point of e.g., 0.5 volume %, or e.g., 1 volume %. This set point will generally be in the range of 0.4–1.2 volume % of carbon monoxide in the dilute phase.

In accordance with another embodiment of this invention, a cracking process is provided for. In this cracking process a cracking catalyst is circulated from a cracking zone to a regeneration zone and back. In the regeneration zone coke is contacting with a free oxygen containing gas, such as air, in order to burn off a substantial portion of said coke. In accordance with this invention, the regeneration zone is controlled in the dual mode described. The preferred variations of this control systems are also the preferred variations for this cracking process.

Further preferred features of this invention will become apparent from the following description of the specific embodiment shown in the drawing.

In a regenerator vessel 1, coke-laden cracking catalyst in a dense bed 2, is contacted with air introduced into the regenerator via air distibutors 3. Flue gas leaves the regenerator via cyclone separators and via conduit 4. The spend and coke-laden cracking catalyst comes from a catalytic cracking reactor (not shown in the drawing) via line 5. The coke-laden or spent cracking catalyst passes in contact with air from the air blower 6 through a regenerator riser 7 into the regenerator vessel 1. A flow recorder controller 8 is used to control the air flow from the air blower 6 through the riser 7 as well as the air distributors 3.

A secondary air blower 9 is used for injecting additional air into the regenerator. The flow of air from this secondary air blower into the regenerator is used for the air flow control. The manipulation of the air flow is done by manipulating a vent valve 10 via a flow recorder controller 11. A speed governor 12 maintains the speed of the air blower 9 at a preselected value.

The control system of this invention utilizes two input signals to generate one control signal. An automatic analyzer 14 determines the volume percent of carbon monoxide in the gas leaving the regenerator 1 via pipe 4. A signal generator 15 generates a carbon monoxide signal representative of the carbon monoxide content in the gas which signal is introduced into the computer control at input 16.

A temperature sensor 17 determines the temperature of the gas in conduit 4 and a temperature signal generator 18 generates a signal representative of this temperature which is introduced into the computer control via input 19.

The computer control generates an output signal leaving the control system at output 20 to control the quantity of air vented by valve 10 and thereby to control the total air flow into the regenerator. It is within the scope of this invention to manipulate the total air flow to the regenerator by other means than by the manipulation of a vent valve of a secondary blower. Other possibilities would for instance be the direct control of the air blower speed. However, the manipulation of a vent valve is a fast reacting manipulation which does not need the change of rotational speeds of high masses such as air blowers.

Referring now to FIG. 2 of the drawing, the control system has as the main element a switch 23 which, when operated, switches from a direct acting proportional plus integral (PI) controller 21 to a reverse acting proportional integral (PI) controller 22. The switch 23 is actuated by a high select circuit or program 24 so that the reverse acting controller is utilized to generate the computer output signal at the output 20 when the carbon monoxide signal at the input 16 is representative of a carbon monoxide content below the given set point or a carbon monoxide content which is equal to 0. When the carbon monoxide signal entering at input 16 is above the given set point (such as above 0.5 volume percent) the high select circuit 24 causes the switch 23 to return to the direct acting PI controller 21 and thus to generate an output signal at the output 20 which will increase the air flow into the regenerator when the temperature in the dilute phase has fallen below the given set point. When the reverse acting PI controller 22 controls the air flow, the air flow will be decreased when the temperature has fallen below the temperature set point. To manipulate the air flow rate, the air flow rate set point of an air flow controller is normally adjusted. If more air is needed, venting is decreased or air flow is increased; if less air is needed, more air is vented or less air flow is used.

Both proportional integral controllers 21 and 22 are provided with antireset windup means to 210 and 220 respectively. Since all of the control elements such as the PI controllers, the high select circuits and the antireset windup systems are well known in the art, a detailed description of these units can be avoided. The set points for the PI controllers 21 and 22 respectively are entered via their respective set points inputs 211 and 221.

The analyzer 14 (FIG. 1) for determining the carbon monoxide content in the dilute phase is a commercially available chromatographic analyzer. Another possibility to analyze for the quantity of combustibles present would be a direct analysis of the combustibles by combustion.

Reasonable variations of modification will become apparent to those skilled in the art and can be made in this invention without departing from the spirit and scope thereof.

I claim:

1. Apparatus useful for regenerating cracking catalyst and comprising (a) a regenerator vessel, (b) means to introduce cracking catalyst into said vessel, (c) means for introducing a free oxygen containing gas into said regenerator and into contact with said catalyst, (d) an analyzer means for automatically analyzing the flue gas in the regenerator for its carbon monoxide content and generating a corresponding analysis signal, (e) temperature sensor means for automatically measuring the temperature of the flue gas and generating a temperature signal responsive to the measured temperature, (f) a control system receiving said analysis signal and said temperature signal and generating an output signal for the manipulation of said free oxygen containing gas flow, said control system comprising (aa) a direct acting controller and a reverse acting controller, both controllers receiving a set point signal, (bb) a switch means switching the output of one controller or the output of the other controller to the output of the control system, said switch means being connected to the input of the control system, receiving the analysis signal and being adapted to switch from one controller to the other controller and back responsive to said analysis signal and an analysis set point, (g) a controller, controlling the flow of free oxygen containing gas into said regenerator, responsive to said output signal from said control system.

2. Apparatus in accordance with claim 1 wherein said controllers are proportional plus integral controllers provided with antireset windup means.

3. Apparatus in accordance with claim 1 wherein said switch means comprise a high select circuit connected to a switch.

* * * * *